US009017094B2

(12) United States Patent
Ikeda

(10) Patent No.: US 9,017,094 B2
(45) Date of Patent: Apr. 28, 2015

(54) COUPLING STRUCTURE FOR A FLAT WIRING CABLE HAVING NON-UNIFORM PITCH

(75) Inventor: Kei Ikeda, Susono (JP)

(73) Assignee: Yazaki Corporation, Tokyo (JP)

( * ) Notice: Subject to any disclaimer, the term of this patent is extended or adjusted under 35 U.S.C. 154(b) by 442 days.

(21) Appl. No.: 13/512,775

(22) PCT Filed: Nov. 29, 2010

(86) PCT No.: PCT/JP2010/071302

§ 371 (c)(1),
(2), (4) Date: May 30, 2012

(87) PCT Pub. No.: WO2011/065549

PCT Pub. Date: Jun. 3, 2011

(65) Prior Publication Data

US 2012/0238155 A1 Sep. 20, 2012

(30) Foreign Application Priority Data

Nov. 30, 2009 (JP) ..... 2009-271976

(51) Int. Cl.

| | |
|---|---|
| ***H01R 3/00*** | (2006.01) |
| ***H01R 12/59*** | (2011.01) |
| *H01R 12/77* | (2011.01) |
| *H01R 12/81* | (2011.01) |

(52) U.S. Cl.

CPC ..... *H01R 12/592* (2013.01); *H01R 12/777* (2013.01); *H01R 12/81* (2013.01)

(58) Field of Classification Search

USPC ..... 439/709, 260, 499, 626; 174/117 F

IPC ..... H01R 12/592

See application file for complete search history.

(56) References Cited

U.S. PATENT DOCUMENTS

| | | | | |
|---|---|---|---|---|
| 5,824,955 | A * | 10/1998 | Saiso et al. | 174/88 R |
| 5,962,813 | A * | 10/1999 | Shirako et al. | 174/88 R |
| 6,444,910 | B1 * | 9/2002 | Goto | 174/70 B |
| 7,241,173 | B2 * | 7/2007 | Callahan et al. | 439/579 |
| 8,926,359 | B2 * | 1/2015 | de Bruijn et al. | 439/422 |
| 2002/0002016 | A1 | 1/2002 | Sato et al. | |
| 2009/0130873 | A1 | 5/2009 | He | |

FOREIGN PATENT DOCUMENTS

| | | | |
|---|---|---|---|
| CN | 101237129 | A | 8/2008 |
| CN | 201122731 | Y | 9/2008 |

(Continued)

OTHER PUBLICATIONS

European Search Report dated Jun. 2, 2014 issued by the European Patent Office in corresponding European Application No. 10833393.1.

(Continued)

*Primary Examiner* — Vanessa Girardi

(74) *Attorney, Agent, or Firm* — Sughrue Mion, PLLC

(57) ABSTRACT

In a coupling structure of a wiring member for coupling a plurality of connector terminals with the wiring member which is configured by arranging in parallel a plurality of flat-type conductors in a width direction thereof and covering an outer periphery of the flat-type conductors by an insulation member, the connector terminals are electrically coupled to the wiring member in an orthogonal manner so as to match to terminal pitches of a complementary connector.

9 Claims, 6 Drawing Sheets

PITCH SWITCHING

(56) References Cited

FOREIGN PATENT DOCUMENTS

| | | | |
|---|---|---|---|
| JP | 58874 | U | 2/1993 |
| JP | 8162228 | A | 6/1996 |
| JP | 2001177950 | A | 6/2001 |
| JP | 2001266995 | A | 9/2001 |
| JP | 2002093513 | A | 3/2002 |
| JP | 2005310570 | A | 11/2005 |
| JP | 2006164726 | A | 6/2006 |
| JP | 2008108660 | A | 5/2008 |
| JP | 200987833 | A | 4/2009 |
| WO | 2007/027593 | A1 | 3/2007 |

OTHER PUBLICATIONS

Office Action dated Sep. 3, 2013 issued by the Japanese Patent Office in counterpart Japanese Patent Application No. 2009271976.

Machine translation of Japanese Publication No. 2009087833 dated Apr. 23, 2009.

International Search Report (PCT/ISA/210) issued on Dec. 28, 2010 in the International Patent Application No. PCT/JP2010/071302.

Written Opinion (PCT/ISA/237) issued on Dec. 28, 2010 in the International Patent Application No. PCT/JP2010/071302.

Office Action, dated Apr. 2, 2014, issued by the State Intellectual Property Office of the People's Republic of China in counterpart Chinese Application No. 201080054212.8.

Office Action dated Feb. 4, 2014 issued by the Japanese Patent Office in corresponding Japanese Application No. 2009-271976.

Communication, dated Jul. 8, 2014, issued by the Commissioner of JPO in counterpart Application No. 2009-271976.

Office Action, Issued by the State Intellectual Property Office of P.R. China, Dated Aug. 29, 2014, in counterpart Chinese Application No. 201080054212.8.

* cited by examiner

Fig.3

| | | | Connector | | | |
|---|---|---|---|---|---|---|
| | | | terminal pitch constant | | terminal pitch switching | |
| | | | no arrangement switching | arrangement switching | no arrangement switching | arrangement switching |
| FFC | conductor pitch constant | no arrangement switching | (PT0) | PT1 | PT4 | PT5 |
| | | arrangement switching | PT2 | PT3 | PT6 | PT7 |
| | conductor pitch switching | no arrangement switching | PT8 | PT9 | PT12 | PT13 |
| | | arrangement switching | PT10 | PT11 | PT14 | PT15 |

COUPLING STRUCTURE FOR A FLAT WIRING CABLE HAVING NON-UNIFORM PITCH

TECHNICAL FIELD

The present invention relates to the coupling structure of a wiring member for coupling a plurality of connector terminals with the wiring member which is formed by arranging in parallel a plurality of flat-type conductors in the width direction thereof.

BACKGROUND ART

For example, in the electrical wiring for an automobile, there arises a case that it becomes necessary to couple an FFC (Flexible Flat Cable) as the wiring member with a complementary connector. As shown in FIG. 6, an FFC 501 is configured that a plurality of flat-type conductors 503 are arranged in parallel in the width direction a thereof and the outer periphery of the flat-type conductors 503 is covered by an insulation member 505. A complementary connector 507 is configured that not-shown terminals respectively coupled to electric wires 509 are attached within a housing 511. According to the coupling structure of the FFC 501 thus configured, in general, the pitch P1 of the flat-type conductors 503 of the FFC 501 does not coincide with the pitch P2 of the terminals of the complementary connector 507. Thus, there arises a deviation AP due to the difference between these pitches.

In order to obviate such the inconvenience, for example, a patent document 1 discloses the terminal structure of a flat cable for a rotatable connector which is configured that the terminal body of each of a set of two coupling terminals disposed in parallel on the both sides of the center coupling terminal among five coupling terminals is provided with a bent part for displacing the axis line position of a piercing coupling part and the axis line position of a male terminal of the each coupling terminal to a direction where the coupling terminals are arranged in parallel, to thereby make it possible to cope with the pitch switching to improve the workability of the coupling procedure.

Further, a patent document 2 discloses an FFC connector which is configured that the flat-type conductor of the FFC is inserted into a direction switching chip having slits, then the direction switching chip is rotated to twist the flat-type conductor and switch the direction thereof in a horizontally-directed state to a vertical direction by sliding a rack housed between a first housing and a second housing, then the flat-type conductor thus direction-switched is inserted into a conductor supporting part in a state that the pitch of the flat-type conductor is reduced by a pitch switching piece, and is exposed from an opening part formed in the conductor supporting part to thereby be coupled to a complementary connector.

RELATED ART DOCUMENT

Patent Document

Patent Document 1: JP-A-2005-310570
Patent Document 2: JP-A-8-162228

SUMMARY OF THE INVENTION

Problems that the Invention is to Solve

However, according to the terminal structure of the patent document 1, since molds for respectively forming the different bent parts are required for the respective pitch switchings, the productivity is low. According to the FFC connector of the patent document 2, since the rack and the direction switching chip are housed between the first and second housings and the pitch switching piece for switching the pitch of the direction-switched flat-type conductor is provided, the connector structure becomes complicated and the productivity is low.

This invention is made in view of the aforesaid circumstances and an object of this invention is to provide the coupling structure of a wiring member which can be fabricated with a high productivity and can couple a connector with a wiring member having an arbitrary pitch and an arbitrary arrangement.

Means for Solving the Problems

The aforesaid object of this invention can be attained by the following configurations.

(1) A coupling structure of a wiring member for coupling a plurality of connector terminals with the wiring member which is configured by arranging in parallel a plurality of flat-type conductors in a width direction thereof and covering an outer periphery of the flat-type conductors by an insulation member, wherein the connector terminals are electrically coupled to the wiring member in an orthogonal manner so as to match to terminal pitches of a complementary connector.

According to the coupling structure of a wiring member thus configured, the connector terminals are electrically coupled to the wiring member in a manner that terminal pitches of the connector terminals are set so as to match to the terminal pitches of the complementary connector. Thus, the wiring member can be coupled to the complementary connector having the different conductor pitches.

(2) In the coupling structure of a wiring member according to (1), wherein a terminal block is attached to the wiring member, and the terminal block is configured that the connector terminals are disposed in parallel so as to cross with the flat-type conductors on a same plane and be conductively coupled to the predetermined flat-type conductors, respectively.

According to the coupling structure of a wiring member thus configured, the connector terminals of the terminal block to be attached to the wiring member are disposed so as to cross with the flat-type conductors of the wiring member on the same plane and be conductively coupled to the predetermined flat-type conductors, respectively. Thus, the conductor pitches of the wiring member and the terminal pitches of the connector can be arbitrarily switched therebetween, and hence the pitches of the connector terminals can be made coincide with the pitches of the complementary connector. Further, the arrangement of the conductors of the wiring member and the arrangement of the terminals of the connectors can be arbitrarily switched by switching the coupling positions of the conductors. As a result, the conductor arrangement can be made coincide with the arrangement of the complementary connector.

(3) In the coupling structure of a wiring member according to (2), further including a connector housing which is configured that when the terminal block is inserted therein, one ends of the connector terminals are protruded within a fitting space opened at a front surface thereof to be fitted with the complementary connector and the wiring member is derived from a side surface thereof.

According to the coupling structure of a wiring member thus configured, since the connector housing is fit with the complementary connector, the one ends of the connector terminals protruded from the terminal block can be coupled as electrical contact parts to the complementary connector.

(4) In the coupling structure of a wiring member according to (3), wherein a plurality of the terminal blocks are laminated and housed within the connector housing.

According to the coupling structure of a wiring member thus configured, since the connector terminals disposed in parallel on the same plane are also disposed in the lamination direction, the connector terminals are arranged in parallel and at plural stages.

(5) In the coupling structure of a wiring member according to one of (1) to (4), wherein conductor pitches between the respective flat-type conductors of the wiring member are made different according to a circuit to be coupled.

According to the coupling structure of a wiring member thus configured, circuits having different insulation distances can be formed by the single wiring member.

(6) In the coupling structure of a wiring member according to one of (1) to (5), wherein each of width sizes of the flat-type conductors and each of width sizes of the connector terminals coupled to the flat-type conductors is made differ according to a current capacity of a circuit to be coupled thereto.

According to the coupling structure of a wiring member thus configured, the allowable current of the desired flat-type conductors can be changed without changing the thickness of the wiring member.

(7) In the coupling structure of a wiring member according to one of (2) to (6), wherein the terminal block includes partition walls each of which partitions between adjacent ones of the connector terminals so as to protrude toward inside thereof.

According to the coupling structure of a wiring member thus configured, in the terminal block, the insulation distance between the adjacent connector terminals can be secured to thereby prevent the occurrence of short-circuit.

Effects of the Invention

According to the coupling structure of a wiring member according to this invention, the terminal block is attached to the wiring member, and the terminal block is configured that the connector terminals are disposed in parallel so as to cross with the flat-type conductors on the same plane and be conductively coupled to the predetermined flat-type conductors, respectively. Thus, the wiring member having arbitrary pitches and arrangement can be coupled to the connector with high productivity.

BRIEF DESCRIPTION OF THE DRAWINGS

FIG. 3 is a diagram showing the switching variation of pitches and arrangements.

MODE FOR CARRYING OUT THE INVENTION

Hereinafter, an embodiment according to this invention will be explained with reference to drawings.

Figure 1:
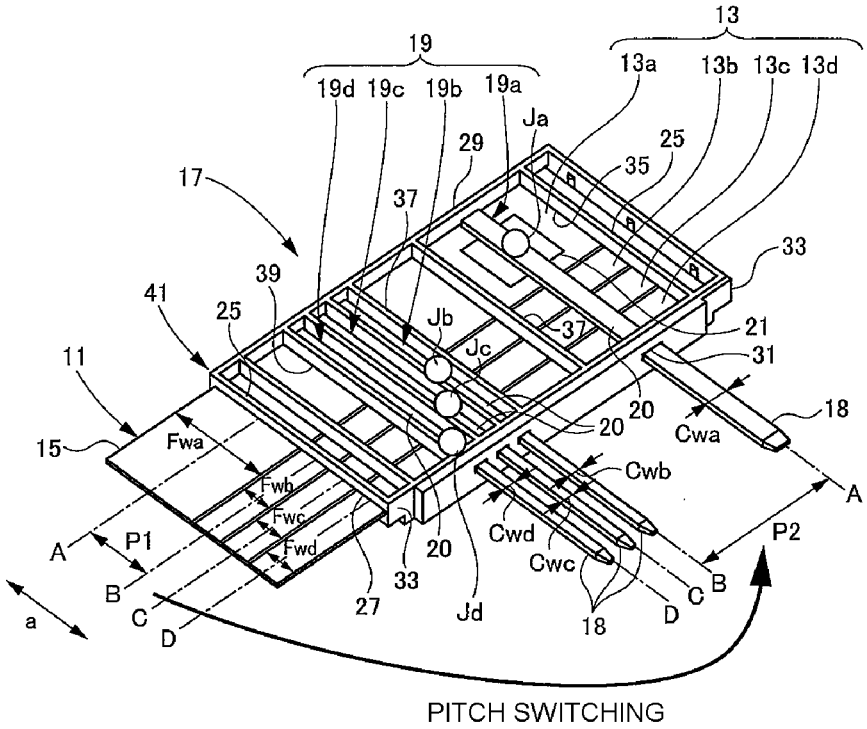
FIG. 1 is a perspective view of a coupling structure according to this invention.

FIG. 1 is a perspective view of the coupling structure according to this invention.

In an FFC 11 as a wiring member, a plurality of flat-type conductors 13 are disposed in parallel in the width direction a thereof. Each of the flat-type conductors 13 is formed by copper or copper alloy. The outer periphery of the flat-type conductors 13 is covered by an insulation member 15. The insulation member 15 is formed by polypropylene (PP) or polybutylene terphthalate (PBT), for example. Since the plurality of flat-type conductors 13 disposed in parallel with predetermined pitches are integrally formed by resin coating configured by the insulation member 15, the FFC 11 has insulating properties and flexibility.

The pitches of the flat-type conductors 13 of the FFC 11 can be made differ according to a circuit to be coupled. Thus, it becomes possible to form circuits having different insulation distances by the single FFC 11.

The FFC 11 is coupled to a not-shown complementary connector. The FFC 11 is attached with a terminal block 17 for coupling with the complementary connector. The terminal block 17 is integrally formed by resin material such as PBT (polybutylene terphthalate). In the terminal block 17, connector terminals 19 are disposed in parallel so as to cross with the flat-type conductors 13 on the same plane and be conductively coupled to the predetermined flat-type conductors 13, respectively.

Each of the connector terminals 19 is formed as a male terminal in this embodiment. In each of the connector terminals 19, a tab-shaped electrical contact part 18 as an end portion thereof is protruded from the terminal block 17. A coupling part 20 provided at the other end portion of each of the electrical contact parts 18 is inserted unto the terminal block 17 and overlapped on the flat-type conductors 13 so as to cross therewith. The coupling part 20 is coupled to the flat-type conductor 13.

In the configuration shown in FIG. 1, the flat-type conductors 13 are configured by four flat-type conductors 13*a*, 13*b*, 13*c* and 13*d*. The flat-type conductors 13*a*, 13*b*, 13*c* and 13*d* are coupled to circuits A, B, C and D, respectively. On the other hand, the connector terminals 19 are configured by four connector terminals 19*a*, 19*b*, 19*c* and 19*d*. The flat-type conductors 13*a*, 13*b*, 13*c* and 13*d* are conductively coupled to the connector terminals 19*a*, 19*b*, 19*c* and 19*d*, respectively. Thus, the connector terminals 19*a*, 19*b*, 19*c* and 19*d* are coupled to the circuits A, B, C and D, respectively.

Each of the flat-type conductors 13 is disposed so as to cross with the connector terminals 19 in an orthogonal manner. The flat-type conductors 13 may cross with the connector terminals 19 at an arbitrary inclination angle therebetween other than a right angle according to the coupling direction with the FFC 11 or the complementary connector.

The crossed and overlapped points between the flat-type conductors 13 and the connector terminals 19 constitute coupling points J (Ja, Jb, Jc, Jd). The conductive coupling at the coupling point J is performed in a manner that the flat-type conductor 13 is exposed at an opening part 21 formed by peeling the insulation member 15 of the FFC 11 and is coupled with the connector terminal 19 by using a method such as the ultrasonic welding, resistance welding, laser welding, clamping, soldering or caulking.

In this embodiment, the flat-type conductor 13 is coupled to the connector terminal 19 by the welding. The flat-type conductors 13 and the connector terminals 19 are conductively coupled with a low resistance and high intensity by the welding and hence electrically coupled with high reliability.

The conductive coupling between the FFC 11 and the connector terminals 19 may be performed in a manner that, at the coupling point J where the opening part 21 is not formed, the connector terminal 19 is pressed against the insulation member 15 while being heated to thereby melt the insulation member 15 to contact the connector terminal with the flat-type conductor 13, and then welded by applying a welding current or ultrasonic vibration thereto.

Each of the width sizes Fwa, Fwb, Fwc, Fwd of the flat-type conductors 13 and each of the width sizes Cwa, Cwb, Cwc, Cwd of the connector terminals 19 coupled to the flat-type conductors 13 can be made differ according to the current capacities of the circuits A, B, C, D to be coupled thereto. Thus, the flat-type conductors 13 can cope with a desired allowable current without changing the thickness of the FFC 11.

The terminal block 17 is formed in a flat rectangular box shape which upper surface is opened. An insertion port 27 for the FFC 11 is opened at a side wall 25 as one of the short-side walls of the terminal block. Projection ports 31 for the connector terminals 19 are opened at a side wall 29 as one of the long-side walls of the terminal block. The side wall 25 as the short-side wall is provided with a positioning frame part 33 acting as a positioning means at the time of laminating the terminal blocks 17 described b later. The FFC 11 inserted from the insertion port 27 is placed on a not-shown bottom plate so as to be in parallel thereto. The tip end of the FFC 11 thus inserted is inserted into a receiving hole 35 formed at a side wall 25 as the other of the short-side walls (inner side in the insertion direction) to thereby be restricted from floating.

A plurality of partition walls 37 are formed between the side walls 29 as the long-side walls so as to be in parallel to the side walls 25 as the short-side walls and protrude from the bottom plate. A slit 39 for penetrating the FFC 11 therethrough is formed between each of the partition walls 37 and the bottom plate. Each of the partition walls 37 acts as an insulation wall for partitioning between the adjacent connector terminals 19. The provision of the partition walls 37 serves to secure the insulation distance between the adjacent connector terminals 19 within the terminal block 17 to thereby prevent the occurrence of short-circuit.

The connector terminals 19 are arranged so as to match to the terminal pitches of the complementary connector. The connector terminals 19 can be configured so as to be inserted into and attached to the projection ports 31 of the side wall 29. Each of the connector terminals is fixed to the side wall 29 by a not-shown detachment restriction means or a press-in engagement means provided at this side wall. In this case, when a plurality of the projection ports 31 capable of coping with different arraignments are provided, the coupling structure can cope with the terminal pitches of different complementary connectors.

The terminal block 17 may be configured by integrally forming a block body 41 made of resin material with the connector terminals 19. For example, a not-shown engagement piece is protrusively provided between the electrical contact part 18 and the coupling part 20 of each of the connector terminals 19 and the engagement piece is integrally formed with the side wall 29. When the block body 41 and the connector terminals 19 are integrally formed, the relative positional accuracy between the block body 41 and the connector terminals 19 can be enhanced. Thus, the positioning accuracy between the flat-type conductors 13 of the FFC 11 attached to the terminal block 17 and the connector terminals 19 can also be enhanced. Further, the connector terminals 19 can be fixed with high intensity and the contact reliability with respect to the complementary connector can also be enhanced.

Next, the action of the coupling structure having the aforesaid configuration will be explained.

In the coupling structure of the wiring member, the terminal block 17 is attached to the FFC 11. In the terminal block 17, the FFC 11 is inserted from the insertion port 27 and the FFC 11 thus inserted is proceeded into the receiving hole 35 via the slits 39 and positioned. The FFC 11 thus positioned is coupled at the coupling points Ja, Jb, Jc, Jd by the welding to the connector terminals 19 overlapping therewith on the upper side thereof.

When the connector terminals 19 have the assembled structure, the connector terminals 19 are inserted into and fixed to the projection ports 31 of the block body 41, respectively. The connector terminals 19 may be fixed after or before the insertion of the FFC 11. When the connector terminals 19 have the integrated structure with the block body 41, the FFC 11 is inserted under the connector terminals 19 having been fixed to the block body 41 in advance.

In the terminal block 17 to be attached to the FFC 11, the connector terminals 19 are disposed so as to cross with the flat-type conductors 13 on the same plane and are conductively coupled to the predetermined flat-type conductors 13, respectively. In this case, the connector terminals 19*a*, 19*b*, 19*c* and 19*d* are disposed with desired pitches along the flat-type conductors 13 so as to coincide with the terminal pitches of the complimentary connector, respectively. For example, when the space between the connector terminals 19*a* and 19*b* is made large, a small pitch P1 between the flat-type conductors 13*a* and 13*b* is switched into a large pitch P2 (P1<P2) between the connector terminals 19*a* and 19*b*. Thus, the conductor pitches of the FFC 11 and the terminal pitches of the connector can be arbitrarily switched therebetween, and hence the pitches of the connector terminals can be made coincide with the pitches of the complementary connector.

Figure 2:
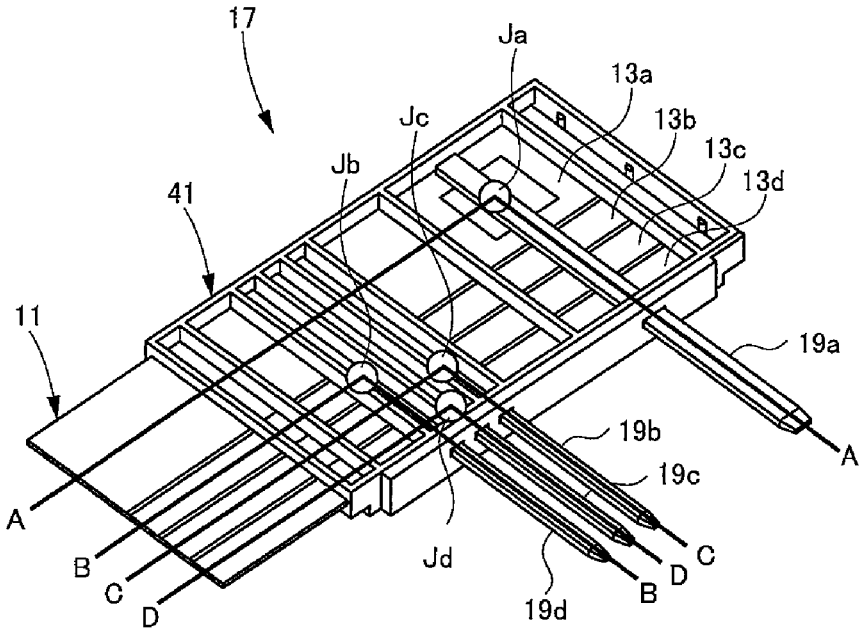
FIG. 2 is a perspective view of the coupling structure in which the arrangement shown in FIG. 1 is switched.

FIG. 2 is a perspective view of the coupling structure in which the arrangement shown in FIG. 1 is switched.

According to the coupling structure of the wiring member, the flat-type conductors 13 and the connector terminals 19 are arbitrarily coupled by switching the coupling points Ja, Jb, Jc, Jd as the conductive coupling positions. For example, as shown in FIG. 2, the connector terminal 19*d* is coupled to the flat-type conductor 13*b* via the coupling point Jb, the connector terminal 19*b* is coupled to the flat-type conductor 13*c* via the coupling point Jc, and the connector terminal 19*c* is coupled to the flat-type conductor 13*d* via the coupling point Jd. Thus, the circuit arrangement A, B, C, D on the FFC 11 side can be switched into the circuit arrangement A, C, D, B on the connector terminals 19 side.

In other words, the arrangement of the conductors (flat-type conductors 13) of the FFC 11 and the arrangement of the terminals of the connectors (connector terminals 19) can be arbitrarily switched. As a result, the conductor arrangement can be made coincide with the arrangement of the complementary connector.

FIG. 3 is a diagram showing the switching variation of the pitches and arrangements.

In the coupling structure of the wiring member, these switching of the pitches and arrangements is performed by using the terminal block 17. Supposing that the coupling structure of the FFC 11 and the connector terminals 19 each of which has the same constant pitch and has no arrangement switching is a basic pattern (PT0), the coupling structure of this invention is considered to have 15 kinds of switching patterns (PT1 to PT15) shown in FIG. 3 with respect to the basic pattern (PT0). The pattern PT0 shown in FIG. 3 represents a case that each of the flat-type conductors 13 and the connector terminals 19 has the same pitch and has no arrangement switching. In this case, the direct coupling eliminating the terminal block 17 is possible.

A pattern PT12 represents a case where the FFC 11 is partially switched in the conductor pitches but not switched in the arrangement, and the connector terminals 19 are partially switched in the terminal pitches but not switched in the arrangement. That is, this pattern represents the coupling structure shown in FIG. 1. A pattern PT13 represents a case where the FFC 11 is partially switched in the conductor pitches but not switched in the arrangement, and the connector terminals 19 are partially switched in the terminal pitches and are switched in the arrangement. That is, this pattern represents the coupling structure shown in FIG. 2.

Next, an applied example of the aforesaid coupling structure will be explained.

Figure 4:
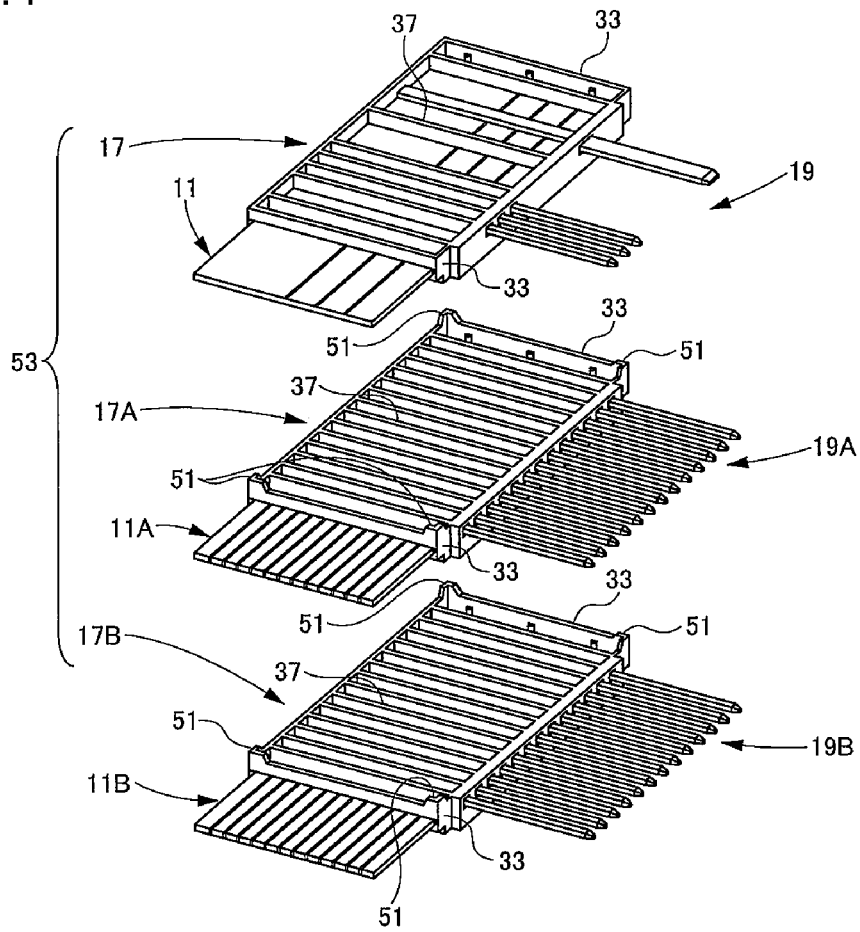
FIG. 4 is an exploded perspective view of a laminated terminal blocks.

FIG. 4 is an exploded perspective view of the laminated terminal blocks.

The terminal block 17 can be configured by laminating terminal blocks. Other terminal blocks 17A, 17B to be laminated are respectively configured by coupling FFC 11A, 11B to connector terminals 19A, 19B by using the same configuration explained above. The terminal block 17 is provided with the positioning frame part 33. Each of the other terminal blocks 17A, 17B to be laminated on the terminal block 17 is provided with a positioning frame part 33 having the similar configuration as the aforesaid positioning frame part and also provided with erection walls 51 which engage with the corner portions of the positioning frame part 33 from the lower direction to thereby restrict the position. The terminal blocks 17, 17A, 17B constitute a single laminated member 53 by engaging the positioning frame parts 33 with the erection walls 51. In this laminated member 53, since the connector terminals disposed in parallel on the same plane are also provided in the lamination direction, the connector terminals 19A, 19B, 19C are arranged in parallel and at plural stages.

Figure 5:
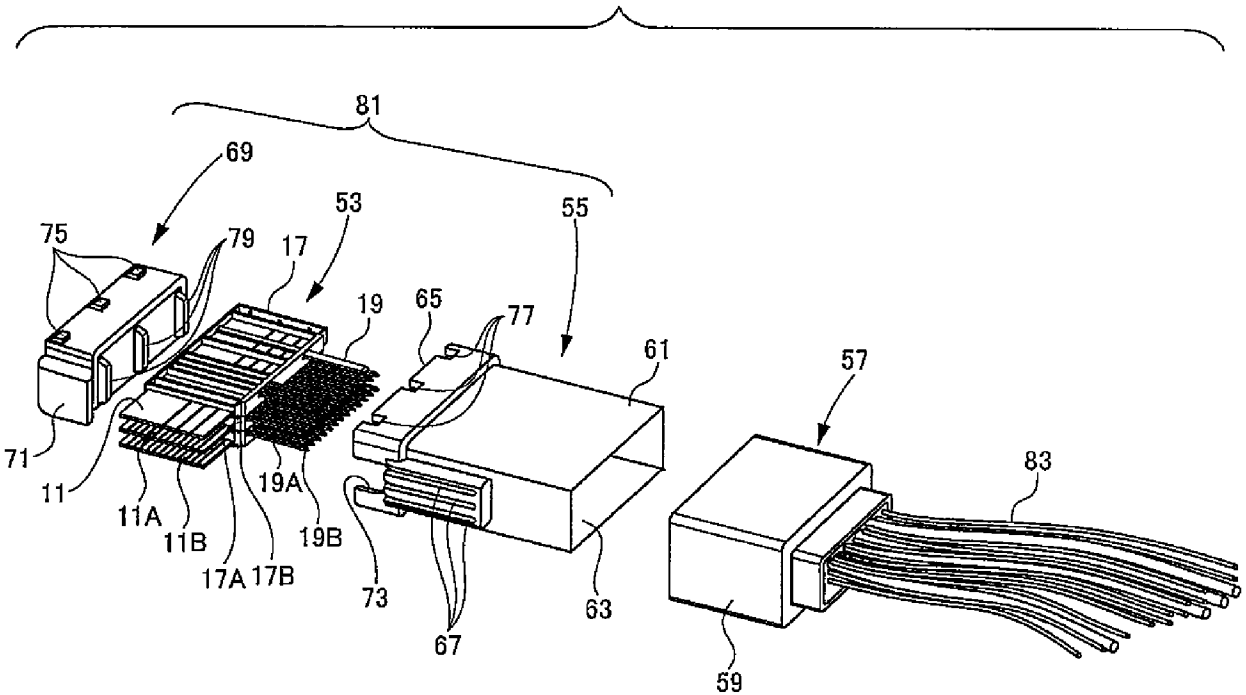
FIG. 5 is an exploded perspective view of the coupling structure for housing the laminated terminal blocks within a connector housing.
Figure 6:
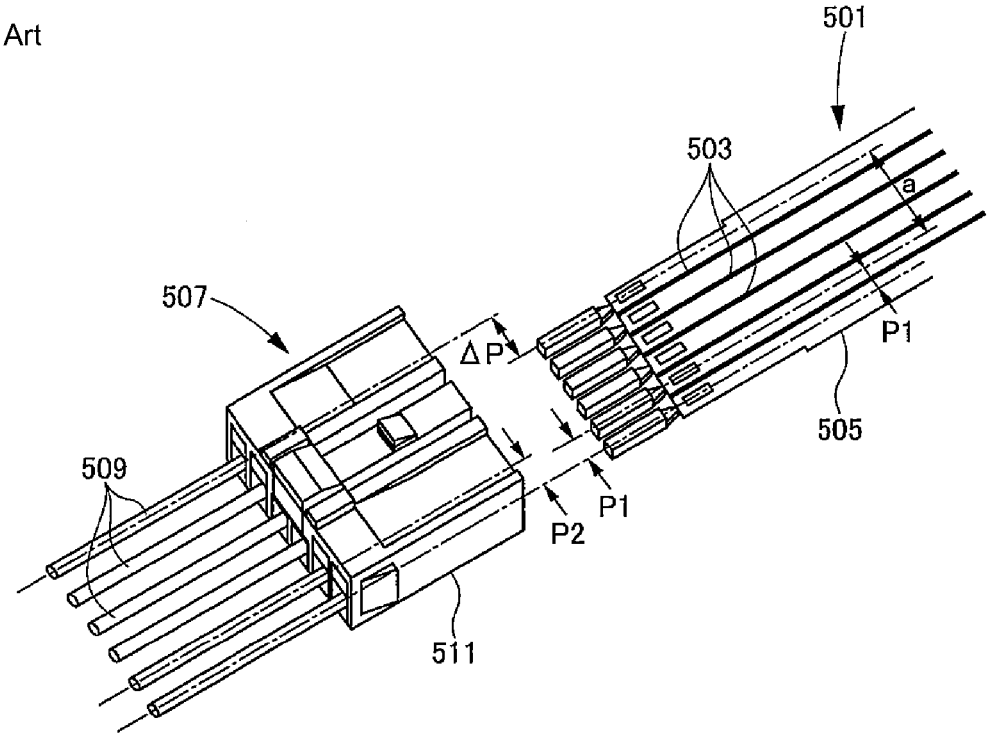
Fig.6 Prior Art
FIG. 6 is a perspective view showing the coupling structure of a wiring member of a related art.

FIG. 5 is an exploded perspective view of the coupling structure for housing the laminated terminal blocks within a connector housing.

The laminated member 53 configured by integrating the terminal blocks 17, 17A, 17B is housed within the connector housing 55. The connector housing 55 is formed in a rectangular and cylindrical shape in a manner that the fitting side with a complementary connector 57 is set as the front side and an opposite side to the fitting side is set as the rear side. A fitting part 61 to be inserted into the inside of the hood part 59 of the complementary connector 57 is formed at the front part of the connector housing 55. The inside of the fitting part 61 forms a fitting space 63. A rear surface opening part 65 is formed on the rear side of the fitting part 61. The laminated member 53 can be inserted into the rear surface opening part 65. On the side surface of the connector housing 55, three notches 67 are formed in parallel in the elevational direction so as to receive the respective FFCs 11, 11A, 11B of the laminated member 53 to be inserted from the rear surface opening part 65, respectively.

A cover 69 is engaged with the rear surface opening part 65 of the connector housing 55. The cover 69 is restricted from being detached in a manner that engagement parts 75 thereof are engaged with the engagement parts 77 of the rear surface opening part 65 while the convex walls 71 at the both sides thereof are inserted into fitting parts 73 formed at the both side walls of the rear portion of the connector housing 55, respectively. That is, the cover 69 is attached to the rear surface opening part 65 of the connector housing 55 to thereby restrict the detachment of the laminated member 53. Thus, the laminated member 53 is restricted from being detached from the connector housing 55 and hence integrated therewith. A plurality of parallel pressing projections 79 for pressing the laminated member 53 are provided at the front surface of the cover 69 each so as to protrude and extend in the elevational direction.

In the connector housing 55, when the laminated member 53 is inserted therein, the electrical contact parts 18 (see FIG. 1) of the connector terminals 19 are protruded within the fitting space 63 opened at the front surface thereof to be fitted with the complementary connector 57, and the FFCs 11, 11A, 11B are derived from the side surface thereof.

The connector housing 55, the laminated member 53 and the cover 69 constitute a flat wiring member connector 81. In the flat wiring member connector 81, when the connector housing 55 is fitted with the complementary connector 57, the electrical contact parts 18 of the respective connector terminals 19, 19A, 19B protruded from the laminated member 53 are made in contact and electrically coupled with the female terminals (not shown) coupled to the electric wires 83 of the complementary connector 57, respectively.

As described above, according to the coupling structure of the wiring member according to this embodiment, the terminal block 17 is attached to the FFC 11, and the terminal block 17 is configured that the connector terminals 19 are disposed in parallel so as to cross with the flat-type conductors 13 on the same plane and be conductively coupled to the predetermined flat-type conductors 13, respectively. Thus, the FFC 11 having the arbitrary pitches and arrangement can be coupled to the complementary connector 57 with high productivity.

Although the invention is explained in detail with reference to the particular embodiment, it will be apparent for those skilled in the art that various changes and modifications are possible without departing from the spirit and range of this invention.

This invention is based on Japanese Patent Application (Japanese Patent Application No. 2009-271976) filed on Nov. 30, 2009, the content of which is incorporated herein by reference.

Explanation of Signs

11 FFC (wiring member)
13 flat-type conductor
15 insulation member
17 terminal block
19 connector terminal
37 partition wall
41 block body
55 connector housing
57 complementary connector
63 fitting space
65 rear surface opening part of connector housing
69 cover
A, B, C, D circuit to be coupled
Cwa, Cwb, Cwc, Cwd width size of connector terminal
P1 conductor pitch between flat-type conductors
P2 terminal pitch between connector terminals
a width direction

The invention claimed is:

1. A coupling structure of a wiring member for coupling a plurality of connector terminals with the wiring member comprising:

the wiring member including a plurality of flat-type conductors arranged in parallel in a width direction of the wiring member and covered on an outer periphery of the flat-type conductors by an insulation member;

the plurality of connector terminals electrically coupled to the wiring member in an orthogonal manner so as to match to terminal pitches of a complementary connector, wherein a first pitch of at least one flat-type conductor of the plurality of flat-type conductors is different from that of remaining flat-type conductors of the plurality of flat-type conductors and a second pitch of at least one connector terminal of the plurality of connector terminals is different from that of remaining connector terminals of the plurality of connector terminals.

2. The coupling structure of the wiring member according to claim 1, wherein conductor pitches between the respective flat-type conductors of the wiring member are made different according to a circuit to be coupled.

3. The coupling structure of the wiring member according to claim 1, wherein each of width sizes of the flat-type conductors and each of width sizes of the connector terminals coupled to the flat-type conductors is made differ according to a current capacity of a circuit to be coupled thereto.

4. The coupling structure of the wiring member according to claim 1, wherein the second pitch is greater than the first pitch.

5. The coupling structure of the wiring member according to claim 1, wherein each of the terminal is formed in a rectangular box shape in which upper surface is opened, wherein each of the terminal blocks has a positioning frame part formed at a side wall and an erection wall provided on the positioning frame part; and wherein the terminal blocks are stacked to each other by engaging the positioning frame parts with the erection walls to constitute a single laminated member.

6. The coupling structure of the wiring member according to claim 1, wherein a terminal block is attached to the wiring member, and the terminal block is configured that the connector terminals are disposed in parallel so as to cross with the flat-type conductors on a same plane and be conductively coupled to the predetermined flat-type conductors, respectively.

7. The coupling structure of the wiring member according to claim 6, wherein the terminal block includes partition walls each of which partitions between adjacent ones of the connector terminals so as to protrude toward inside thereof.

8. The coupling structure of the wiring member according to claim 6, further comprising a connector housing which is configured that when the terminal block is inserted therein, one ends of the connector terminals are protruded within a fitting space opened at a front surface thereof to be fitted with the complementary connector and the wiring member is derived from a side surface thereof.

9. The coupling structure of the wiring member according to claim 8, wherein a plurality of the terminal blocks are laminated and housed within the connector housing.

* * * * *